US006312878B1

(12) United States Patent
Thomas

(10) Patent No.: US 6,312,878 B1
(45) Date of Patent: Nov. 6, 2001

(54) COLOR PHOTOGRAPHIC DEVELOPER KIT

(75) Inventor: Francoise M. Thomas, Chalon sur Saone Cedex (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/674,020

(22) PCT Filed: Feb. 14, 2000

(86) PCT No.: PCT/EP00/01186

§ 371 Date: Oct. 24, 2000

§ 102(e) Date: Oct. 24, 2000

(87) PCT Pub. No.: WO00/54106

PCT Pub. Date: Sep. 14, 2000

(30) Foreign Application Priority Data

Mar. 8, 1999 (FR) ..... 99 02972

(51) Int. Cl.[7] ..... G03C 7/413

(52) U.S. Cl. ..... 430/466; 430/450; 430/489

(58) Field of Search ..... 430/466, 467, 430/489

(56) References Cited

U.S. PATENT DOCUMENTS 3,832,179 8/1974 Edens ..... 430/467

FOREIGN PATENT DOCUMENTS

1468015 * 3/1977 (GB) .

* cited by examiner

*Primary Examiner*—Hoa Van Le

(57) ABSTRACT

This invention concerns a kit for the development of color photographic products. The kit comprises a basic solution containing an antifogging agent, and a second solution containing a color developing agent. This kit allows an easier preparation of the developer and of replenishment solutions of the developer.

6 Claims, No Drawings

COLOR PHOTOGRAPHIC DEVELOPER KIT

FIELD OF THE INVENTION

This invention concerns a photographic developer kit for processing color photographic materials, and a method for preparing a developer from said kit.

BACKGROUND OF THE INVENTION

In the color photographic film processing, color developers are used that contain as their main constituent a color developer in an alkaline-medium. Such a color developer also contains other constituents such as permeabilizing agents, antifogging agents, preservatives, etc.

It is known that the different constituents of a color developer can be packaged separately. It is thus obtained kits for photographic processing, generally comprising several parts each containing one or more constituents of the developer. These different parts are mixed, and if necessary diluted by the end user, to obtain the ready-to-use color developer. Such packaging in kit form is necessary because the different constituents of the color developer become unstable once present together in the same solution. Further, photographic processing kits are designed to facilitate the preparation of the ready-to-use developer by a non-specialized end user.

For processing motion picture film, there exists a kit comprising two concentrated solutions, called concentrates, namely an alkaline concentrate and a concentrate containing the developer, and a solid part consisting of 3,5-dinitrobenzoic acid as a wet powder. This arrangement does not allow the automated manufacture of the kit, because the packaging of the powder is difficult to industrialize.

In addition, to obtain a homogeneous developer from these liquid concentrates and this solid part, it is necessary to mix the different components of the kit in a certain order, so that the powder dissolves completely.

SUMMARY OF THE INVENTION

One object of the present invention is to provide a color developer kit with a simplified packaging and improved stability, that is easier to industrialize. A further object of the invention is to provide the end user with a kit that allows a simple, rapid, and reproducible preparation of the ready-to-use color developer. A further object of the invention is to provide a kit that affords an efficient ready-to-use color developer.

These objects are achieved by the present invention, which concerns a photographic developer kit comprising two concentrates.

DETAILED DESCRIPTION OF THE INVENTION

One of the concentrates, Concentrate (A), is a basic aqueous solution having a pH greater than 8 containing a compound of formula (I):

(I)

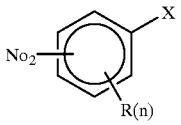

where X is —COOH or —$SO_3H$, M is an alkali metal or ammonium, R is an lower alkyl group with preferably from 1 to 3 atoms of carbon, and n is 0, 1, 2 or 3.

The second concentrate, Concentrate (B), is an aqueous acidic solution containing a color developer of the paraphenylenediamine type.

The redox potential of compound (I) is preferably greater than −700 mV.

The redox potential of compound (I) is measured against a Ag/AgCl/KCl, 3M reference electrode.

The invention further concerns the use of this kit for the preparation of a ready-to-use color developer, and a method for the preparation of a ready-to-use color developer that comprises mixing the two concentrates (A) and (B) in any order.

In one embodiment, the position of the nitro group is meta or para to the X group, and n is 0, i.e., the benzene ring bears no alkyl group. In another embodiment, the nitro group is para or meta to the X group, R is an lower alkyl group and n is 1, 2 or 3.

In the scope of the invention, the compound of formula (I) can be 3-nitrobenzoic acid (redox potential −650 mV), 4-nitrobenzoic acid (redox potential −580 mV), 3-nitrobenzenesulfonic acid (redox potential −600 mV), and 4-nitrobenzenesulfonic acid. Because the compound (I) is dissolved in a basic solution, it occurs as a salt, for example a salt of sodium, potassium, lithium or ammonium.

In any cases the volume and concentration of the concentrate (A) will be adjusted to obtain a ready-to-use developer containing between $2\times10^{-4}$ mole/l and $3\times10^{-3}$ mole/l (0.350 g/l) of compound (I).

In a specific embodiment, the concentrate (A) contains the nitrobenzoic acid as its sodium salt at a concentration between $2.5\times10^{-3}$ mole/l and $15\times10^{-3}$ mole/l.

In a specific embodiment, the concentration of the sodium salt of the nitrobenzoic acid in the concentrate (A) is about $7.5\times10^{-3}$ mole/l.

The kit of this invention has a particularly simple packaging because it comprises only two liquid concentrates. It allows a rapid and simple preparation of the ready-to-use color developer by the end user. Photographic materials processed from the kit of the invention exhibit good sensitometric results, in particular low fogging without reduced rapidity.

The concentrate (A) useful in this invention is a basic solution obtained from alkaline compounds such as sodium or potassium carbonate, borax, sodium or potassium hydroxide, or sodium metaborate, in aqueous solution. This concentrate (A) can contain chelating agents, water softeners such as aminopolycarboxylic acids, for example ethylenediaminetetra-acetic acid (EDTA), diethylenetriaminepenta-acetic acid (DTPA), isopropanoldiaminetetra-acetic acid (DPTA), aminopolyphosphonic acids, for example amino-N,N dimethylenephosphonic acids, hexametaphosphate, Dequest® (2000, 2006, 2010, etc.), and Versenex 80®.

The volume and the pH of the concentrate (A) will be adjusted to obtain a ready-to-use developer with a pH of at least 8, preferably between 10 and 12.

The developer used in the concentrate (B) is generally a p-phenylenediamine, for example 2-amino-5-diethylaminotoluene (known as CD2), 4-amino-N-ethyl-N-(β-methanesulfoamidoethyl)-m-toluidine (CD3), 4-amino-3-methyl-N-ethyl-N-(β-hydroxyethyl)aniline (CD4). CD2 is generally used in color developers for positive motion picture films, CD3 is generally used in color developers for negative motion picture films, and intermediate motion picture films.

The developer concentration and the volume of the concentrate (B) will be adjusted to obtain a ready-to-use developer containing a developer concentration of at least $7\times10^{-3}$ mole/l, and preferably between $9\times10^{-3}$ and $2\times10^{-2}$ mole/l.

The concentrate (B) containing the color developer can contain other compounds such as for example antioxidants or surfactants. The antioxidants that can be used in the concentrate (B) are for example alkali metal sulfites, metabisulfites and bisulfites, sulfur compounds able to generate sulfite ions in aqueous solution, ascorbic acid and its derivatives, and hydroxylamine derivatives, etc.

In a specific embodiment, the concentrate (B) contains CD3 as color developer, and sulfite. The pH of this concentrate is kept acidic, preferably between 2.5 and 3.5.

These concentrates are mixed at the time of use either to prepare a color developer, or to prepare a replenishment or maintenance solution to maintain the efficiency of the developer during use. In the scope of the invention, the concentrates can be mixed in any order. To make the preparation of the ready-to-use developer even easier, the volumes of the concentrates (A) and (B) can be such that mixing the concentrates yields one liter of color developer without having to dilute the mixture.

The concentrates (A) and (B) can contain other compounds, for example antiseptics, heat stabilizers, developing activators such as thioether or oxothioether compounds, or benzylamine.

After mixing the concentrates, it may be necessary to adjust the pH to a value advantageously between 10.0 and 11.0, or to buffer the mixture to obtain a ready-to-use color developer.

In a specific embodiment, the kit of the present invention is designed for the preparation of a color developer for negative motion picture films such as Eastman Color Negative® marketed by Kodak. Conventionally, this process comprises a color development step in the presence of CD3, a bleaching step, and a fixing step. The bleaching step and the fixing step can be replaced by a single bleaching-fixing step. One or more washing baths can be inserted between these successive steps.

The present invention is illustrated by the following examples.

EXAMPLE 1

Preparation of Concentrate A

In a vessel fitted with a magnetic stirrer containing 950 ml of distilled water, were added 4.0 g of NaBr, 125.8 g of $Na_2CO_3$, 3.02 g of $NaHCO_3$, and 19.3 g of DEQUEST 2006 chelating agent in 40% solution. To this stirred solution was added $7.5\times10^{-3}$ moles of 3,5-dinitrobenzoic acid as indicated in Table I below. Nitrobenzoic acids marketed by Aldrich were used in dry powder form. This solution was stirred for 30 minutes to obtain complete dissolution of the nitrobenzoic acid in the solution. Demineralized water was added to this solution to obtain 1 liter of solution. The pH of the solution was 10.9.

TABLE I

| | Concentration in the concentrate A (g/l) |
|---|---|
| A - 3,5-dinitrobenzoic acid (control) | 1.58 |
| B - 3-nitrobenzoic acid | 1.247 |
| C - 4-nitrobenzoic acid | 1.247 |
| D - 3-nitrobenzene sulfonic acid | 1.683 |

All these concentrations in g/l correspond to $7.5\times10^{-3}$ mole/liter.

In this way the concentrate (A) was obtained containing the nitrobenzoic acid as its sodium salt.

EXAMPLE 2

A sample of the concentrate (A) prepared by the procedure of example 1 was kept in a plastic bottle at 50° C. for times indicated in Table II below. Samples of the concentrate were taken at 9, 20, 30, 37 and 83 days, and the quantity of nitrobenzoic acid remaining (quantity of salt) was measured. The variation in the amount of nitrobenzoic acid between the freshly prepared concentrate and the concentrate at time t (expressed in %) is given in the table below. The quantity of nitrobenzoic acid was measured by HPLC (variability of measurement +/−2%).

The following results were obtained:

TABLE II

| | Variation (%) of nitrobenzoic acid | | | |
|---|---|---|---|---|
| number of days | AF-9 | 3NBA | 4NBA | 3NBSA |
| 0 | 0 | 0 | 0 | 0 |
| 9 | 0 | 0 | 0 | 0 |
| 20 | 0 | 0 | 0 | 0 |
| 30 | 2.10 | 0 | 0 | 0 |
| 37 | 4.66 | 0 | 0 | 0 |
| 83 | 9.87 | 0 | 0 | 0 |

AF-9: 3,5-dinitrobenzoic acid
3NBA: 3-nitrobenzoic acid
4NBA: 4-nitrobenzoic acid
3NBSA: 3-nitrobenzene sulfonic acid No crystallization was observed during this time (crystallization test carried out at 5° C.).

EXAMPLE 3

In this example, 1 liter of ready-to-use developer was prepared from the concentrate (A) prepared previously, and a concentrate (B) with the following composition:

| Concentrate (B) (1 liter) | |
|---|---|
| demineralized water | 912 ml |
| anhydrous sodium sulfite | 52.9 g |
| CD3 | 116.3 g |
| pH at 25° C. | 3 |

To obtain 1 liter of ready-to-use developer (replenisher), 198.5 ml of concentrate (A) was mixed with 47.25 ml of the concentrate (B) of example 1.

An Eastman Color Intermediate 5274® negative color film was exposed through a step tablet with 21 density ranges, each of these ranges having an increment of 0.15 LogE with an exposure light of color temperature 2,850 K and a D1 illuminator (Tungsten) for 1/50 sec. The film was developed using an ECN-2® photographic process, which comprises the developer prepared in example 3, a bleaching bath, a fixing bath, and a final washing bath, the film and the process both being commercialized by Kodak.

By reading in the three colors blue, green and red on a densitometer, the following sensitometric results were obtained (freshly prepared baths).

| | Red-sensitive layer | Green-sensitive layer | Blue-sensitive layer |
|---|---|---|---|
| Dmin (+/−0.04) | 0.180 (0.177) | 0.560 (0.557) | 0.926 (0.924) |
| Dmax (+/−0.10) | 1.467 (1.468) | 2.050 (2.053) | 2.327 (2.331) |
| Contrast (+0.04) | 0.532 (0.534) | 0.589 (0.590) | 0.578 (0.573) |
| Speed (+4) | 523.6 (523.5) | 530.5 (530.1) | 518.8 (519.9) |

0: value obtained when the developer contained 3,5-dinitrobenzoic acid.

Dmin=minimal density corresponding to an unexposed part of the film (support+fog).

Dmax=maximal density of film.

Speed=100(3-LogE), E being the exposure at the density point Dmin+1.

Contrast=slope of the straight line between the point of density Dmin+0.20 and that of the exposure above 1.35 LogE.

What is claimed is:

1. A kit for a color photographic developer comprising two concentrated solutions wherein (i) one of the concentrated solutions is a basic solution having a pH greater than or equal to 8, and containing at least one compound of the formula:

(I)

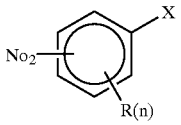

wherein X is —COOM or —$SO_3M$ with M selected from the group consisting of hydrogen, alkali metal counter ion and ammonium counter ions, R is an alkyl group having from 1 to 3 carbon atoms, and n is equal to 0, 1, 2 or 3, and (ii) the second concentrated solution is an acidic aqueous solution having a pH less than or equal to 3 comprising a paraphenylenediamine color developing agent.

2. The kit according to claim 1 wherein the compounds of formula (I) have a redox potential greater than −700 mV.

3. The kit according to claim 1 wherein the compound of formula (I) is selected from the group consisting of 3-nitrobenzoic acid, 4-nitrobenzoic acid, 3-nitrobenzene sulfonic acid, and 4-nitrobenzene sulfonic acid.

4. The kit according to claim 1 wherein the compound (I) is present in a quantity between $2.5\times10^{-3}$ mole/l and $15\times10^{-3}$ mole/l.

5. The kit according to claim 1 wherein the color developing agent is present in the concentrated solution in a quantity between $9\times10^{-3}$ and $2\times10^{-2}$ mole/l.

6. A method for preparing a color developer which comprises the step of mixing:

(a) a basic concentrated solution having a pH greater than or equal to 8, and containing at least one compound of the formula:

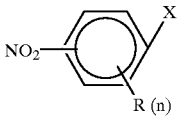

wherein X is —COOM or —SO3M with M selected from the group consisting of hydrogen, an alkali metal counter ion and an ammonium counter ion, R is an alkyl group having from 1 to 3 carbon atoms and n is 0,1,2,3, with, (b) an acidic concentrated solution having a pH less than or equal to 3 comprising a paraphenylenediamine color developing agent, in order to obtain an homogeneous color developer.

* * * * *